United States Patent [19]

Wright

[11] Patent Number: 4,699,074

[45] Date of Patent: Oct. 13, 1987

[54] ACCESSORY FOR YACHTS

[76] Inventor: Brian L. Wright, 338 Bideford Green, Linslade Beds. LU77TX, England

[21] Appl. No.: 874,519

[22] Filed: Jun. 16, 1986

[51] Int. Cl.[4] ..... B63B 21/16

[52] U.S. Cl. ..... 114/218; 254/266

[58] Field of Search ..... 114/188, 218, 253, 254, 114/364, 221 R; 254/266, 344, 369, 371; 74/532

[56] References Cited

U.S. PATENT DOCUMENTS

| | | | |
|---|---|---|---|
| 1,820,923 | 9/1931 | Sturges | 114/218 |
| 2,833,240 | 5/1958 | Semolic | 114/218 |
| 2,991,046 | 7/1961 | Parsons | 114/218 |
| 3,776,517 | 12/1973 | Davis et al. | 114/218 |
| 4,352,337 | 10/1982 | Wjorar | 114/364 |
| 4,597,354 | 7/1986 | Gelula | 114/364 |
| 4,627,374 | 12/1986 | Wright | 114/218 |

FOREIGN PATENT DOCUMENTS

| | | | |
|---|---|---|---|
| 2100213 | 7/1985 | United Kingdom | 114/218 |

*Primary Examiner*—Joseph F. Peters, Jr.
*Assistant Examiner*—Stephen P. Avila

[57] ABSTRACT

An accessory or an accessory mount for yachts comprises a device having an integral supporting leg which is adatped to locate in the handle receiving socket of a winch and be releasably locked in the winch. The locking device comprises a locking plate provided at the lower end of a post which passes upwardly through the leg and which is rotatable about its longitudinal axis to rotate the locking plate to and from an operative position in which it traps the leg against being pulled out of the handle receiving socket. The post which is preferably made of steel projects upwardly beyond the leg to provide a spigot mounting for an accessory or accessory platform.

3 Claims, 4 Drawing Figures

20
27
17
24
21
26
4
2
8
3
25
16
18
19
23
22
1
5
6

15
13
4
14
2
6
12
1

1
5
11
12
13
SECTION A-A

ACCESSORY FOR YACHTS

This invention relates to an accessory or an accessory mount for yachts of the kind described in my British Patent Application No. 8207122 and European Patent Application No. 82306818.4. In my aforesaid applications, there is described an accessory or an accessory mount for a yacht comprising a device not normally involved with the operation of a winch and having an integral supporting leg which is adapted to locate in the handle receiving socket of a winch and be releasably locked in the winch.

In my aforesaid applications, the locking device comprises a locking plate at the lower end of the leg and which is rotatable about the longitudinal axis of the leg, so that when it is rotated to an operative position it projects beyond the cross-section of the leg so that it can trap the leg against being pulled out of the handle receiving socket of a winch.

In one ebodiment described in the aforesaid European Application the locking plate is provided at the lower end of a post which passes upwardly through a bore in the leg and is rotatable about its longitudinal axis within the bore to rotate the locking plate. The present invention is concerned more particularly with an accessory or accessory mount in accordance with this embodiment.

According to the invention, the post projects upwardly beyond the leg to provide a spigot mounting for an accessory platform or an accessory itself.

A construction in accordance with the invention has the advantage that an accessory platform connects directly through to the winch via the post. Hence a very strong mounting can be provided by making the post of, for example, steel. The remaining components can then be made economically of plastic mouldings.

One accessory mount in accordance with the invention will now be described by way of example with reference to the accompanying drawings, in which.

Figure 2:
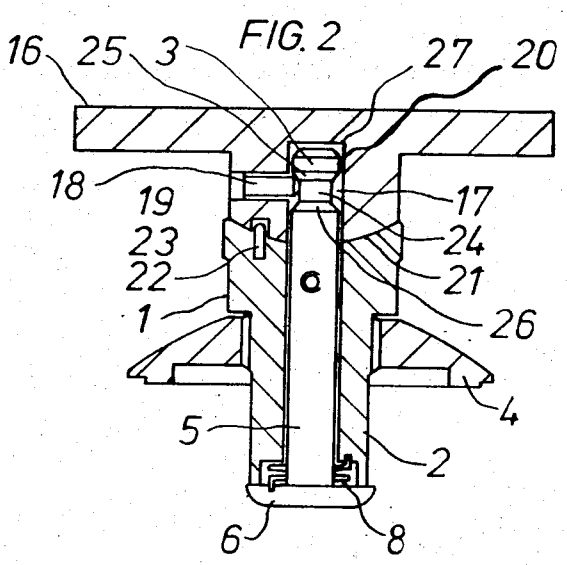
FIG. 2 shows a sectional elevation of the accessory mount.
Figure 1:
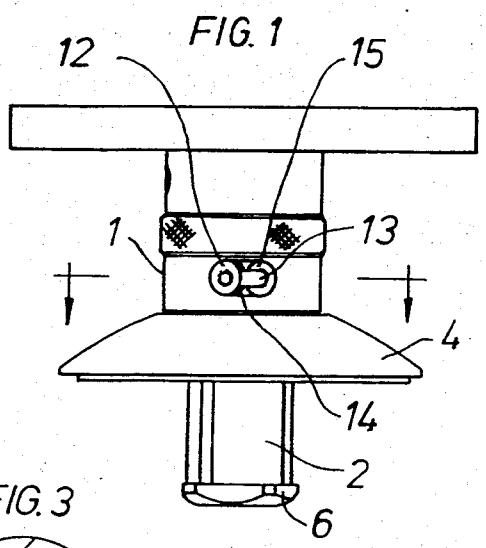
FIG. 1 shows a side view of the accessory mount
Figure 3:
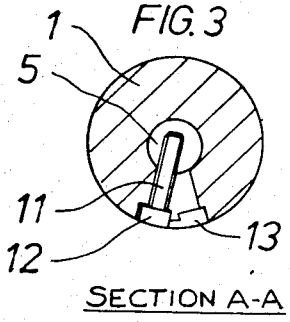
FIG. 3 shows a section on the line A—A of FIG. 1.
Figure 4:
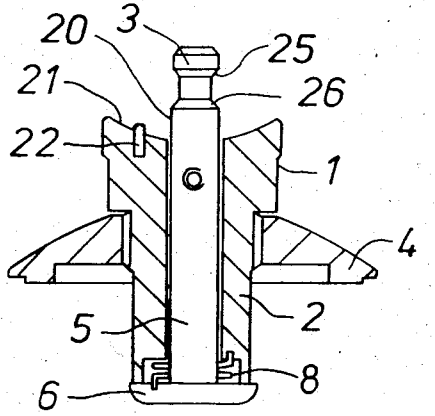
FIG. 4 shows a sectional view corresponding to FIG. 2, but with the accessory platform removed.

Referring now to the drawings, the accessory mount has a head 1 of circular cross-section and a downwardly extending leg 2 of square cross-section which is designed to locate and key with the handle receiving star socket of a winch. The head 1 and leg 2 are formed integrally with each other as a moulding of plastics material. The head 1 has a threaded lower section which threadly receives a clamping ring 4.

In order to lock the leg 2 in the winch handle receiving socket, a cylindrical post 5 extends axially through and is rotatably located in the leg 2. The post 5 has a locking plate 6 integrally formed at its lower end which lies outside of and closely adjacent the lower end of the leg 2. The post 5 and plate 6 are advantageously formed from stainless steel. The plate 6 has the same square cross-section as the leg 2. Thus the edges of the plate 6 can be aligned with the sides of the leg 2 so that the leg can be inserted into the socket. The plate 6 passes right through beyond the star socket so that when it is then rotated by rotation of the post 5 its edges become misaligned with the sides of the leg 2 and becomes trapped behind the socket to lock the accessory mount in the socket. The locking plate 6 is biased to its non-aligned position by a tension spring 8.

The clamping ring 4 enables any slackness in the mounting in the winch socket to be taken up and by its engagement of the top of the winch body or barrel at a position around the outside of the winch socket prevents, by a frictional coupling, rotation of the winch socket. This is because conventionally in many winches the sockets rotate contrawise to the barrel due to the internal mechanism of the winch.

In order to rotate the locking plate 6, a threaded pin 11 engages a threaded bore in the upper end of the post 5. At one end the pin 11 has a head 12 for effecting angular movement 11 to rotate the post 5 and hence the plate 6. The angular movement of the pin 11 is defined by a slot 13 in head 1. At its outer end this slot is recessed to provide two locations 14 and 15 for the head 12 of the pin 11. Thus, if the pin 11 is screwed in so far that the head 12 locates in one of these slots positions 14 and 15 it prevents the pin 11 from being angularly displaced and this locks the plate 6 in one or other of its two positions.

In order to mount accessories, the post 5 extends upwardly as a spigot 20, above the head 1. A platform 16 for an accessory or the base of an accessory is provided with a bore 17 into which the spigot locates. A grub screw 18 is then screwed into its bore 19 which intersects the bore 17 and engages the spigot to lock the platform in position.

Advantageously, the upper face 21 of the head 1 is dished and the underside of the platform 16 has a complementary convex curvature. A pin 22 may project from the accessory mount head 1 and locate in a blind bore 23 in the convex surface of platform 16 to locate the platform 16 and prevent any rotation of the platform relative to the accessory mount. It will also lock the post 5 and hence the plate 6 against rotation. The effect may also be achieved by tongue and groove methods instead of a pin and blind bore.

The spigot 20 is shaped like the studs in my Patent Application No. 8426585. Thus the spigot 20 comprises a head portion 3 at its free end, an adjacent neck portion 24 which leads in to the head portion 3 through sloping shoulder 25 and connectes with the lower portion of the post 5 through sloping shoulder 26. Thus, when the grub screw 18 is screwed into its bore it engages the shoulder 25 and as it is screwed in further rides down the shoulder 25 to pull the platform 16 on to the spigot 20 and create a tight locking action between the convex surface of the platform accessory, and the concave suface of the accessory mount head 1.

I claim:

1. A mounting device capable of rigidly mounting an accessory or one of a range of accessories on a yacht, comprising: a mounting head for supporting the accessory; a supporting leg depending from said mounting head and adapted to locate in a handle receiving socket of a winch; a locking device comprising a locking post which passes longitudinally through said leg and which is rotatable about its longitudinal axis, a locking plate fixed at the lower end of said post so that it rotates with said post to and from an operative position in which it projects beyond the cross-section of the leg so that it can trap the leg against being pulled out of the handle receiving socket, and a pin threadedly engaging the post and extending as an arm therefrom through a slot in said mounting head, the ends of the slot limiting the rotational movement of the plate; and a mounting spigot for a said accessory comprising an upward projection of said post from said mounting head.

2. A mounting device according to claim 1, wherein said post and locking plate are formed from steel.

3. A mounting device according to claim 1 or 2, wherein said pin at its end remote from the post has a head which can, by screwing of the pin in the post, become positioned in shaped locations in said slot to prevent rotation of said locking plate.

* * * * *